United States Patent [19]

Calvert

[11] Patent Number: 5,019,029

[45] Date of Patent: May 28, 1991

[54] MACHINE FOR ERECTING SLEEVE TYPE CARTONS

[75] Inventor: Rodney K. Calvert, Dunwoody, Ga.

[73] Assignee: The Mead Corporation, Dayton, Ohio

[21] Appl. No.: 434,190

[22] Filed: Nov. 13, 1989

[51] Int. Cl.[5] ..... B31B 1/78; B31B 5/80

[52] U.S. Cl. ..... 493/315; 493/318

[58] Field of Search ..... 493/309, 312, 315, 318

[56] References Cited

U.S. PATENT DOCUMENTS

| | | | |
|---|---|---|---|
| 2,765,715 | 10/1956 | Kerr | 493/318 |
| 3,190,193 | 6/1965 | Randles | 493/312 |
| 3,242,827 | 3/1966 | Winters | 493/315 |
| 3,457,843 | 7/1969 | Bower | 493/309 |
| 3,575,409 | 4/1971 | Calvert | 271/27 |
| 3,580,143 | 5/1971 | McIntyre | 493/313 |
| 3,584,434 | 6/1971 | Ellis | 53/159 |
| 3,956,976 | 5/1976 | Vogel et al. | 493/315 |
| 3,991,660 | 11/1976 | Calvert et al. | 493/316 |
| 4,194,442 | 3/1980 | Martelli | 493/315 |
| 4,516,765 | 5/1985 | Stocco et al. | 271/95 |
| 4,537,587 | 8/1985 | Langen | 493/315 |
| 4,596,545 | 6/1986 | Greenwell | 493/315 |
| 4,881,934 | 11/1989 | Harston et al. | 493/315 |

*Primary Examiner*—William E. Terrell

*Attorney, Agent, or Firm*—Rodgers & Rodgers

[57] ABSTRACT

A machine for sequentially withdrawing collapsed sleeve type end loading cartons having face contacting panels in one of which panels an aperture is formed and for initiating set up of the carton into open ended condition, the machine comprising a carton pick up device for sequentially engaging and withdrawing collapsed cartons from the hopper, and an elongated support rod on which the carton pick up device is slidably mounted, the support rod being arranged so that one end thereof extends through the aperture in one of the carton panels and into engagement with the other face contacting panel so as to initiate a set up condition of the carton in coordination with sliding movement of the carton pick up device relative to the elongated support rod.

9 Claims, 3 Drawing Sheets

MACHINE FOR ERECTING SLEEVE TYPE CARTONS

TECHNICAL FIELD

This invention relates to packaging of articles such as cans or bottles in end loading sleeve type cartons and is concerned more particularly with an arrangement for feeding such collapsed cartons from a hopper and for setting up such collapsed cartons into open ended condition for subsequent loading through one or both ends of the sleeve.

BACKGROUND ART

U.S. Pat. No. 3,575,409 issued Apr. 20, 1971 and owned by the assignee of this invention discloses a feeder mechanism for withdrawing cartons from a hopper. This patent does not perform a set up operation for a sleeve type collapsed carton blank.

U.S. Pat. No. 3,991,660 issued Nov. 16, 1976 and owned by the assignee of this invention discloses a feeder mechanism which withdraws a collapsed carton from a hopper and initiates set up of the carton by utilizing a main feeder arm in cooperation with a supplementary feeder arm.

SUMMARY OF THE INVENTION

According to this invention in one form, collapsed sleeve type cartons having face contacting panels are withdrawn from a hopper in sequence by feeder means slidably mounted on a rotatable elongated support rod which enters an aperture formed in one face contacting panel of the carton blank and engages the other face contacting panel to initiate set up movement in coordination with sliding movement of the carton pick up means in a direction away from the hopper. Completion of the set up operation is effected by depositing the partially set up carton between a leading and a trailing flight bar which bars grip oppositely disposed walls of the carton to complete the set up operation.

BEST MODE OF CARRYING OUT THE INVENTION

Figure 2:
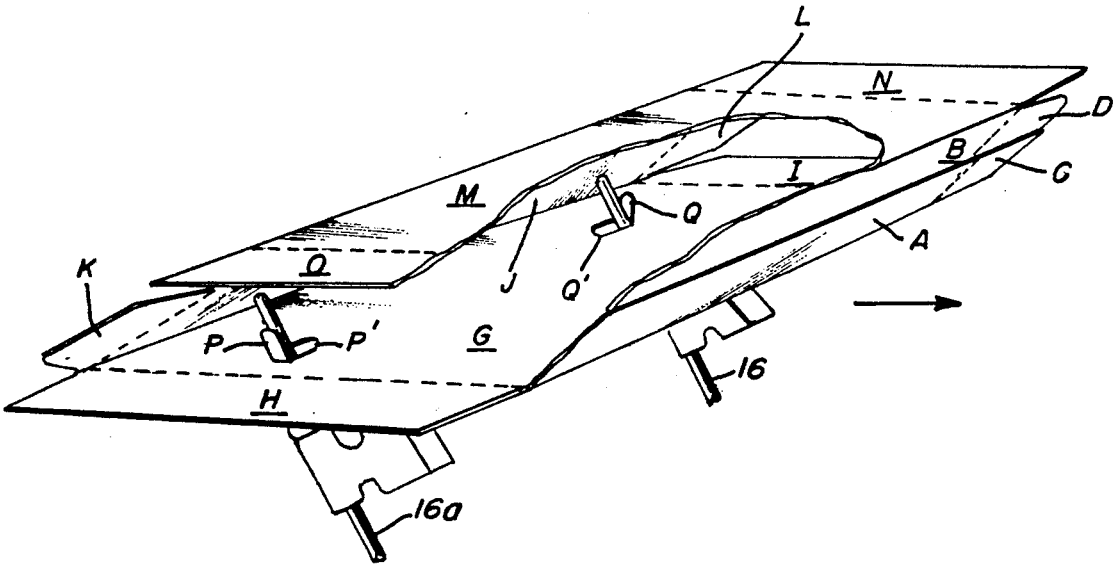
FIG. 2 is a perspective view of an open ended sleeve type carton in partially set up condition and which shows a pair of elongated rods projecting through apertures formed in a wall of the carton and which shows the elongated rods in engagement with a face contacting wall of the carton.

As shown in FIG. 2 a sleeve type carton of the type to which this invention is applicable includes a bottom wall made up of over lapping glued panels A and B. End flaps C and D are foldably joined to one end of the bottom wall and end flaps not shown are foldably joined to the other end of the bottom wall. Side wall G and end flaps H and I are foldably joined. The top wall is indicated at J and end flaps K and L are foldably joined to the end edges of top wall J while side wall M and end flaps N and 0 are foldably joined.

In accordance with this invention, a pair of U-shaped tabs P and Q are struck from side wall G and define apertures P′ and Q′.

In accordance with a feature of this invention, carton pick up means is slidably mounted on elongated rods so that when panel G is drawn downwardly out of its hopper and slidable along elongated rods, these rods enter the U-shaped apertures P′ and Q′ defined by tabs P and Q and engage the inner surface of top wall J which is initially disposed in flat face contacting relation with side wall G. By this means, a set up operation is initiated.

Figure 1:
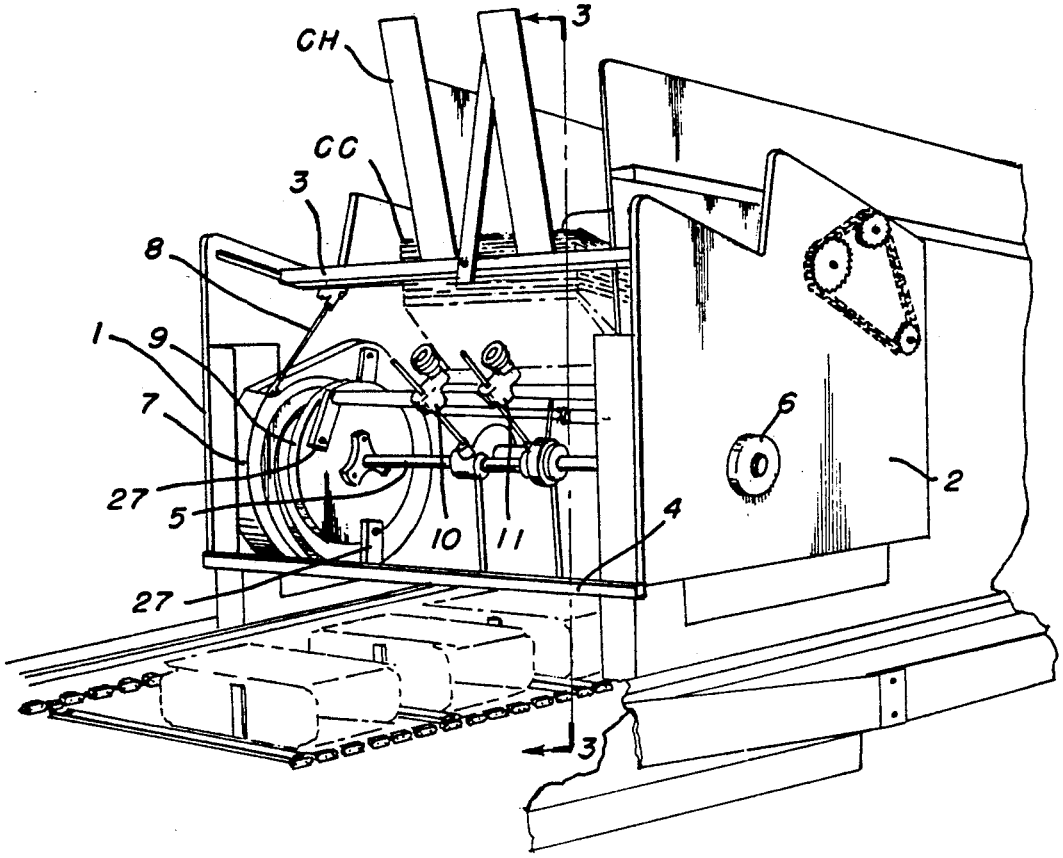
FIG. 1 is a perspective view of a packaging machine constructed according to this invention.

With reference to FIG. 1, a pair of side frame support panels 1 and 2 are shown interconnected by a transverse pair of rods 3 and 4. Rods similar to 3 and 4 are interconnected with the side support panels 1 and 2 at the right hand edges of these panels but these rods are not shown in FIG. 1.

The hopper generally designated at CH is supported by suitable structure mounted on side support panels 1 and 2 and a group of collapsed sleeve type cartons are shown in the hopper and are designated at CC.

The feeder mechanism formed according to this invention includes a rotatable shaft designated by the numeral 5 which is journalled in bearing structure 6 suitably mounted in side panel 2. Drive shaft 5 is driven by suitable known mechanism mounted on the far side of support wall 1 but is not shown in the drawing. A fixed cam plate 7 is mounted on the inner surface of side support plate 1 and is adjustably positioned on side plate 1 by a turnbuckle designated by the numeral 8. Fixed cam plate 7 is provided with an aperture not shown through which drive shaft 5 extends. A rotatable plate 9 is fixedly secured to drive shaft 5 and is rotatable therewith. Rotatable plate 9 is disposed in close proximity to fixed cam plate 7.

Figure 3:
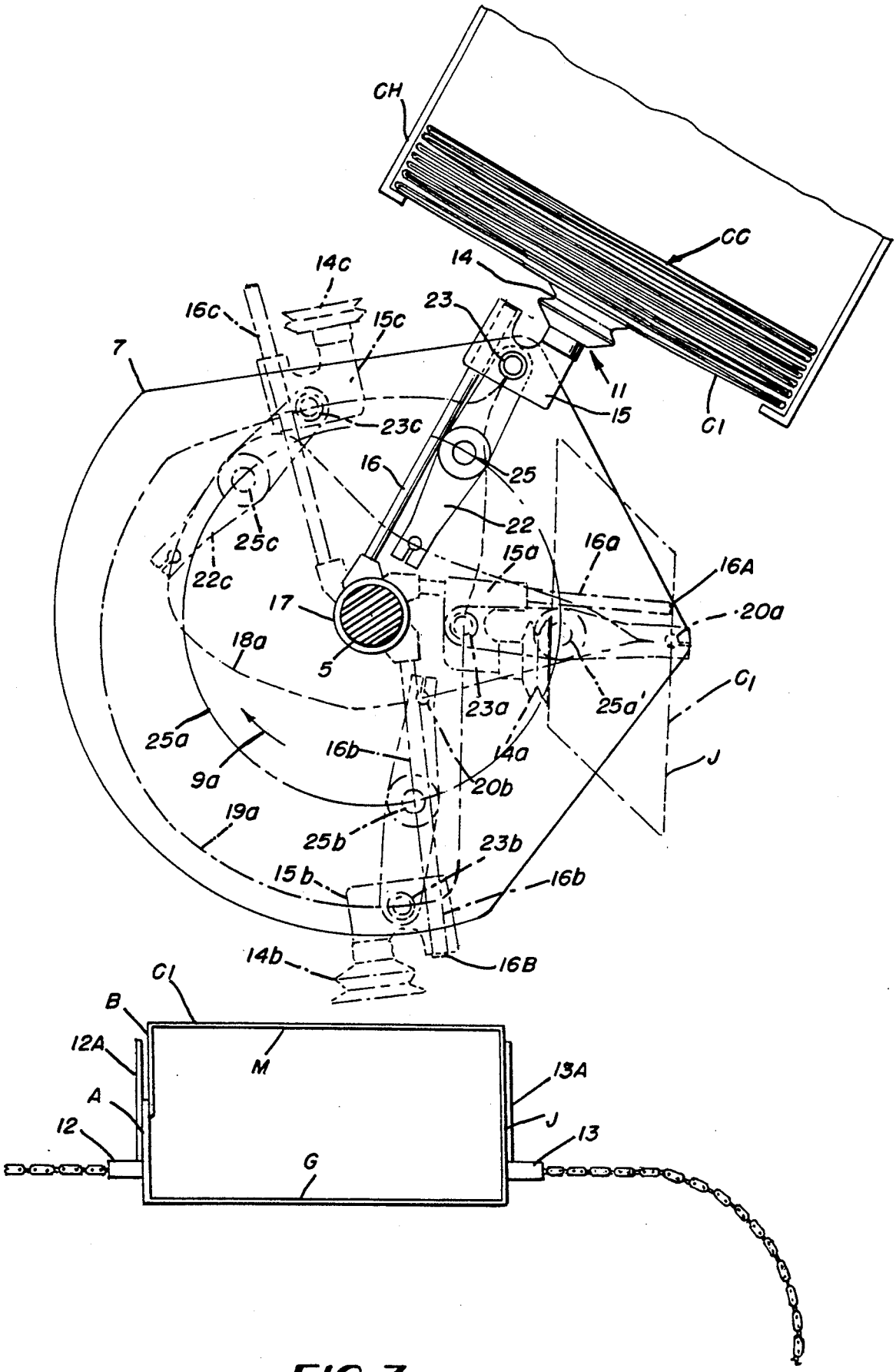
FIG. 3 is a cross sectional view of the machine taken along the line designated 3—3 in FIG. 1.
Figure 4:
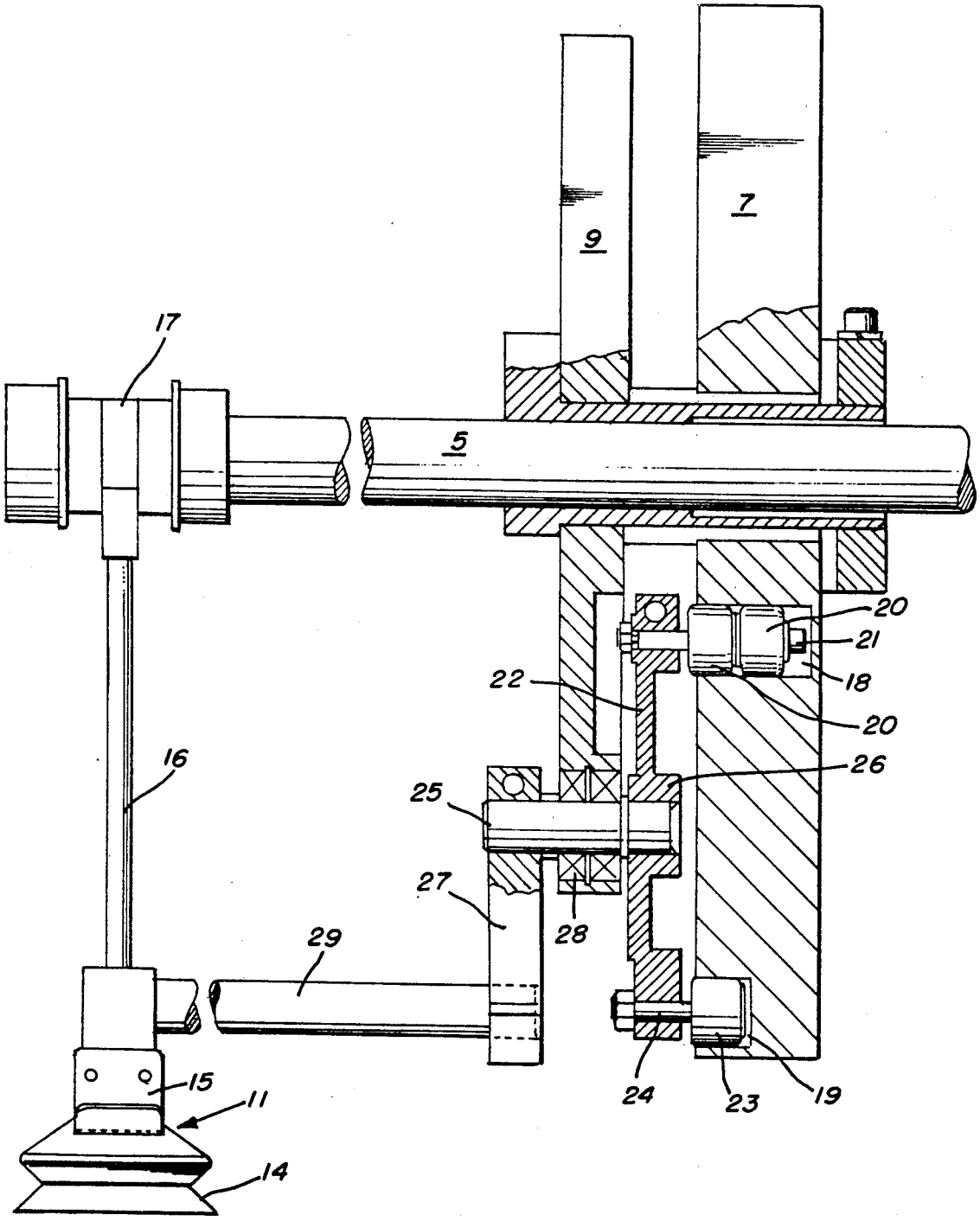
FIG. 4 is an enlarged view partially in section of carton pick up means and its cam operated control system.

For withdrawing the lowermost collapsed carton from the hopper CH, a pair of pick up elements 10 and 11 are reciprocally movable radially and rotatable about shaft 5 as an axis and are arranged sequentially to engage and withdraw cartons while simultaneously initiating set up thereof by cam operated means shown in FIGS. 3 and 4 which show only a single pick up means and associated structure although in practice a plurality of pick up means and associated structures ordinarily are used.

Suitable flight bars of known construction are movable from right to left as viewed in FIG. 1 and a partially set up carton is deposited between a leading and a following flight bar and its set up operation is thus completed. Leading flight bar 12 and its finger 12*a* and trailing flight bar 13 and its finger 13*a* are shown in connection with the final set up condition of carton C1 in FIG. 3 in which the carton C1 is shown with its side wall G at the bottom of the carton.

With reference to FIG. 3, one pick up means such as that indicated by the numeral 11 is shown in solid lines at the instant of engagement with the lowermost carton C1 in hopper CH. The other three views of pick up device 11 are shown in phantom lines and simply illustrate the manipulation of the parts as a feeding operation progresses.

In FIG. 3, fixed cam plate 7 is shown in outline form along with rotatable drive shaft 5. Rotatable plate 9 is not shown in FIG. 3.

As shown in FIGS. 3 and 4, feeder mechanism 11 includes a vacuum cup 14 mounted on cup holder 15 which is slidably disposed on an elongated support rod 16. Vacuum pressure is supplied by known means not shown to cup 14. The end of elongated support rod 16 which cooperates with drive shaft 5 includes a collar structure 17 which is disposed about the drive shaft 5. In FIG. 2 two support rods 16 and 16*a* are shown.

For the purpose of manipulating the elongated support rod and the associated pick up device 11, suitable cam mechanism is provided and includes a deep cam track 18 best shown in FIG. 4 and a shallow cam track 19. Dual cam rollers 20 are disposed in deep cam track 18 and are rotatably mounted on stem shaft 21 which in turn is fixedly mounted at its left hand end as shown in FIG. 4 to cam bar 22.

In like fashion single cam roller 23 is disposed within cam track 19 and is rotatable about stem shaft 24 secured to cam bar 22.

For interrelating the manipulations of cam bar 22 with elongated support rod 16 and with pick up device 11, a cam shaft 25 is fixedly mounted within the hub 26 of cam bar 22. Cam shaft 25 is rigidly secured at its opposite end to cam arm 27 and is journally mounted for rotation within bearings 28 disposed in rotatable plate 9. Cam rod 29 is rigidly secured at one end to cup holder 15 and at its other end to cam arm 27.

As is indicated in FIG. 3, a path of movement inscribed by cam track 19 is indicated at 19*a* while the path of movement of cam track 18 is designated 18*a* in FIG. 3.

The path inscribed by cam shaft 25 is indicated at 25*a* in FIG. 3 which path is simply a circle as is obvious from FIG. 4.

As viewed in FIG. 3 the direction of rotation of rotatable plate 9 is clockwise as indicated by the arrow 9*a*. Since the path of travel of the single cam roller 23 in cam track 19*a* is up and down while the vacuum cup 14 is engaging and picking up the lowermost carton C1 there is no rotary motion of the vacuum cup 14 during this brief period of time. Thereafter the cup holder 15 and the cup 14 are moved radially inward toward shaft 5. As the parts move from the solid line position shown in FIG. 3 to the positions indicated at 16*a* and at 14*a*, the elongated rod 16 projects through the aperture P' in panel G of carton C1 and the outer end 16A of rod 16 engages panel J of carton C1 whereby the set up of the carton is effectively initiated as shown by the dotted line end view of carton C1. The cam shaft 25 following its circular path 25*a* occupies the position 25*a'* and the cam roller 23 occupies the position 23*a*. This of course is due to the divergent relationship between the cam tracks 18*a* and 19*a* as explained more fully in U.S. Pat. No. 4,625,575 issued Dec. 2, 1986 and owned by the assignee of this invention.

After the parts have moved to the positions indicated at 16*b* and at 14*b*, the vacuum cup and holder have moved radially outward and the vacuum cup 14*b* is beyond the end 16B of the elongated feeder rod 16 so that the outer end 16B of the rod 16 is not in engagement wit panel J of the carton C1. At this point, the vacuum pressure is cut off and the carton is deposited between a leading flight bar such as 12 and a trailing flight bar such as 13 and a continuation of the set up operation is thus effected so that the carton C1 appears as shown in FIG. 3.

Following deposit of the carton such as C1 between the flight bars 12 and 13, the movement of the rotatable plate 9 continues and the parts are manipulated through the position represented at 14*c*, 16*c*, 22*c* and ultimately into the pick up solid line position of the parts represented in FIG. 3.

The U-shaped tabs P and Q are engaged by articles inserted from the ends of the carton and are pushed back into the plane of panel G so as to enhance the appearance of the completed package.

We claim:

1. A machine for sequentially manipulating out of a hopper collapsed sleeve type end loading cartons having face contacting panels in one of which an aperture is formed and for initiating set up thereof into open ended condition, said machine comprising a rotatable shaft, carton pick up means for sequentially engaging and withdrawing collapsed cartons from the hopper, a rotatable elongated support rod having one end thereof secured to said shaft and on which said carton pick up means is mounted for sliding reciprocal movement thereon, means for moving said elongated support rod and carton pick up means so that the other end of said elongated support extends through the aperture in said one face contacting panel and into engagement with the other of said face contacting panels so as to initiate a set up condition of the carton in coordination with sliding movement of said carton pick up means relative to said elongated support rod in a direction away from said hopper.

2. A machine according to claim 1 wherein said carton pick up means comprises a vacuum cup mounted on a cup holder on said elongated support rod.

3. A machine according to claim 1 wherein said elongated support rod is arranged with one end portion thereof in enveloping relation with a drive shaft.

4. A machine according to claim 3 wherein said drive shaft is journally supported at one end in a fixed cam plate having a pair of cam tracks formed therein.

5. A machine according to claim 4 wherein a rotatable plate is mounted on and driven by said drive shaft.

6. A machine according to claim 5 wherein a pair of cam followers are movably mounted on a cam bar interconnected with a cam shaft rotatably mounted on said rotatable plate and arranged to cooperate with said cam tracks respectively for imparting rotary movement to said elongated support rod about said shaft as an axis.

7. A machine according to claim 6 wherein means are provided for imparting radial movement to said cup holder and to said vacuum cup relative to said shaft while the vacuum cup and cup holder are moving toward and away from the hopper to engage and withdraw a carton due to the operation of said cam followers.

8. A machine according to claim 7 wherein said radial movement is in a direction toward said shaft so as to cause the outer end of said elongated support rod to enter said aperture and to engage and move said other of said panels away from said one panel.

9. A machine according to claim 7 wherein said radial movement is in a direction away from said shaft so as to cause said rod to disengage said aperture and wherein said pick up means releases the carton.

* * * * *

UNITED STATES PATENT AND TRADEMARK OFFICE

CERTIFICATE OF CORRECTION

PATENT NO. : 5,019,029

DATED : May 28, 1991

INVENTOR(S) : Calvert

It is certified that error appears in the above-identified patent and that said Letters Patent is hereby corrected as shown below:

In column 4, line 26 after "support" insert - rod -

Signed and Sealed this

Twentieth Day of October, 1992

*Attest:*

DOUGLAS B. COMER

*Attesting Officer*

*Acting Commissioner of Patents and Trademarks*